US005514060A

United States Patent [19]

Hu

[11] Patent Number: 5,514,060

[45] Date of Patent: May 7, 1996

[54] MULTI-STATION EXERCISE MACHINE FRAME STRUCTURE OF A HONEYCOMB-LIKE ARRANGEMENT

[76] Inventor: Chang-Sung Hu, Room 26, 3Fl., No. 5, Sec. 5, Sinyi Rd., Taipei, Taiwan

[21] Appl. No.: 291,206

[22] Filed: Aug. 16, 1994

[51] Int. Cl.[6] ..... A63B 21/00; A63B 21/06; A63B 23/12

[52] U.S. Cl. ..... 482/136; 482/138; 482/100

[58] Field of Search ..... 482/92–94, 97–103, 482/133, 135–138, 142, 148, 35, 36, 134, 100; D21/195

[56] References Cited

U.S. PATENT DOCUMENTS

| | | | |
|---|---|---|---|
| D. 357,957 | 5/1995 | Hung | D21/195 |
| 3,640,528 | 2/1972 | Proctor | 482/102 |
| 3,659,844 | 5/1972 | Cummins | 482/133 |
| 3,686,812 | 8/1972 | Rensch | 52/280 |
| 3,912,261 | 10/1975 | Lambert, Sr. | 482/100 |
| 4,275,534 | 6/1981 | Porter | 52/82 |
| 4,390,179 | 6/1983 | Szkalak | 482/138 |
| 4,478,411 | 10/1984 | Baldwin | 482/100 |
| 4,505,475 | 3/1985 | Olschansky et al. | 482/100 |
| 4,757,992 | 7/1988 | Heitsch et al. | 482/100 |
| 4,804,179 | 2/1989 | Murphy et al. | 482/97 |
| 4,809,972 | 3/1989 | Rasmussen et al. | 482/99 |
| 4,900,018 | 2/1990 | Ish, III et al. | 482/138 |
| 4,986,538 | 1/1991 | Ish, III | 482/100 |
| 5,054,773 | 8/1991 | Parviainen | 482/138 |
| 5,263,915 | 11/1993 | Habing | 482/138 |

FOREIGN PATENT DOCUMENTS

| | | | |
|---|---|---|---|
| 1187523 | 5/1985 | Canada | 482/136 |
| 205072 | 12/1983 | Germany | 482/137 |

*Primary Examiner*—Richard J. Apley
*Assistant Examiner*—Victor K. Hwang
*Attorney, Agent, or Firm*—Bacon & Thomas

[57] ABSTRACT

A multi-station exercise machine frame structure comprising a base support assembly which supports a number of columns for accommodating individual exercise units or stations. The base support assembly is constructed of cross beams connected between bottom parts of associated columns. Expansion of the machine to include one or more additional exercise units or stations is accomplished by adding corresponding columns and connecting additional cross beams of similar construction. In another aspect, a module for a butterfly unit is provided which comprises tilted inlet and outlet pulleys to facilitate a smooth operation of pivoting rods in performing a butterfly exercise.

5 Claims, 7 Drawing Sheets

MULTI-STATION EXERCISE MACHINE FRAME STRUCTURE OF A HONEYCOMB-LIKE ARRANGEMENT

BACKGROUND OF THE INVENTION

The present invention relates to an exercise machine having multiple exercise units of the type which operate via a cable and pulley system in opposition to a single set of weights, and more particularly, to an exercise machine frame structure of which the base support assembly is so constructed and the multiple exercise stations or units are arranged in such a way that the number of exercise units can be easily and conveniently expanded.

An exercise machine having multiple stations at each of which two or more exercises are performed in opposition to a selected amount of weights in a single weight stack is known, for example in U.S. Pat. No. 4,809,972. The whole construction of an exercise machine in accordance with the above patent is substantially fixed, which means the number of exercise units cannot be increased or expanded without greatly affecting the existing design or structure, in particular the base support assembly that carry or support the various exercise stations or units.

SUMMARY OF THE INVENTION

The present invention provides a multi-station exercise machine frame structure of which individual hexagonal columns of the multiple exercise stations or units are disposed at apexes and center of gravity of an approximate regular-triangle defined by a base support assembly. For a standard base support assembly having four columns fixed thereon, since the sides of the regular triangle formed by the base support assembly and the sides of the individual hexagonal columns are of one size respectively, cross beams of only two different design are required to construct the base support assembly.

For an expanded base support assembly, i.e., an assembly with one or more exercise stations or units being added to the standard base support assembly, cross beams of similar design with only different sizes are required and the expansion can be accomplished easily, thus making the machine versatile and saving the endeavor to expand and/or assemble the exercise machine.

In addition to the base support assembly, a feature of the invention lies in a smoothly-operated butterfly module for a butterfly exercise station. The module comprises an inlet pulley and an outlet stationary pulley tilted in opposite directions so that a cable passing over the inlet stationary pulley in a first path can gradually and smoothly pass to following floating pulleys and then to the outlet stationary pulley in a second path which is substantially in line with the first path.

These and various other advantages and features of novelty which characterize the exercise machine frame structure are pointed out with particularity in the claims annexed hereto and forming a part hereof. However, for a better understanding of the invention, its advantages, and the objects obtained by its use, reference should be made to the drawings which form a part hereof, and to the accompanying descriptive matter, in which there is illustrated and described a preferred embodiment of the invention.

DESCRIPTION OF THE PREFERRED EMBODIMENTS

Figure 1:
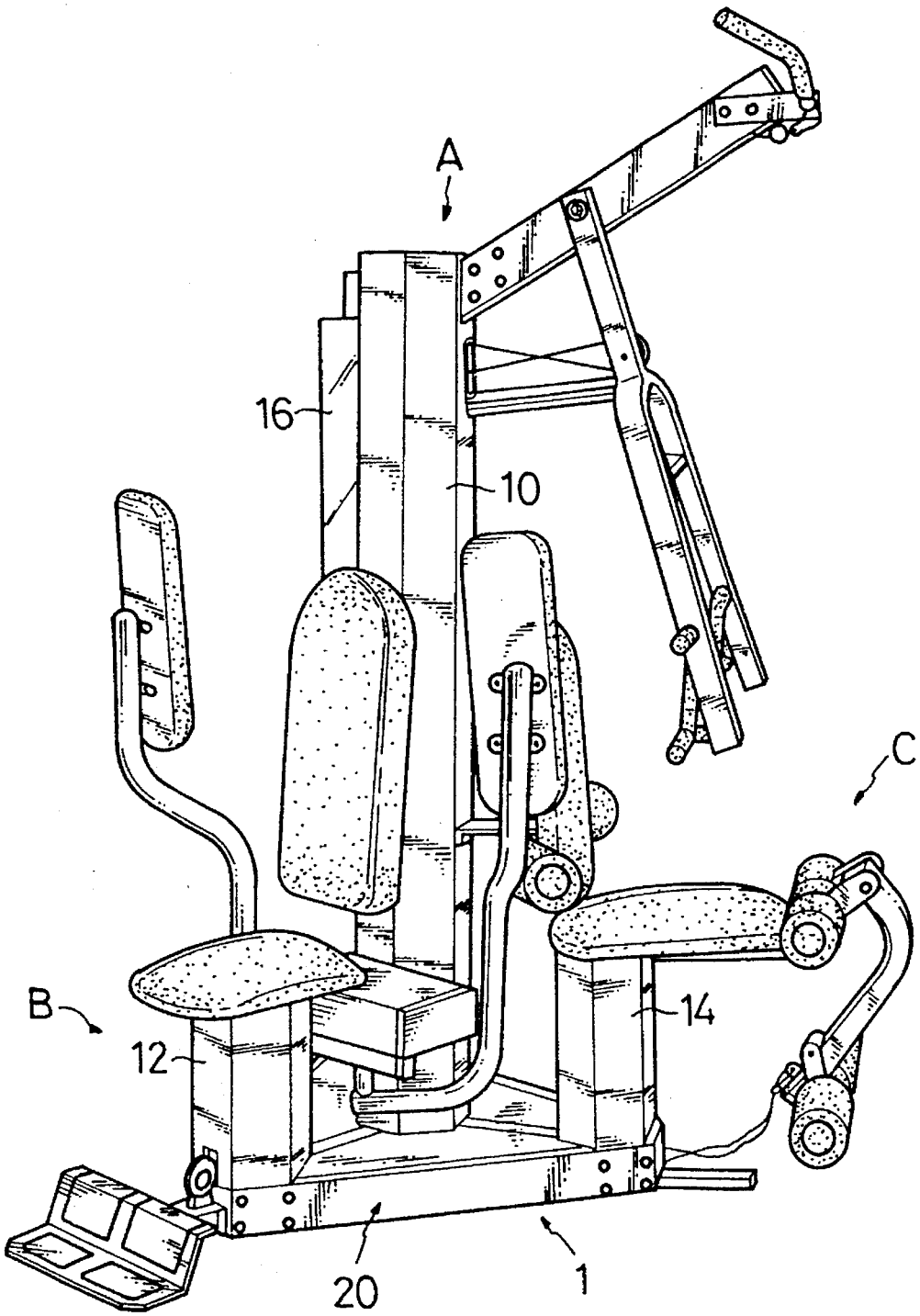
FIG. 1 is a perspective view of an exercise machine constructed in accordance with the present invention.
Figure 2:
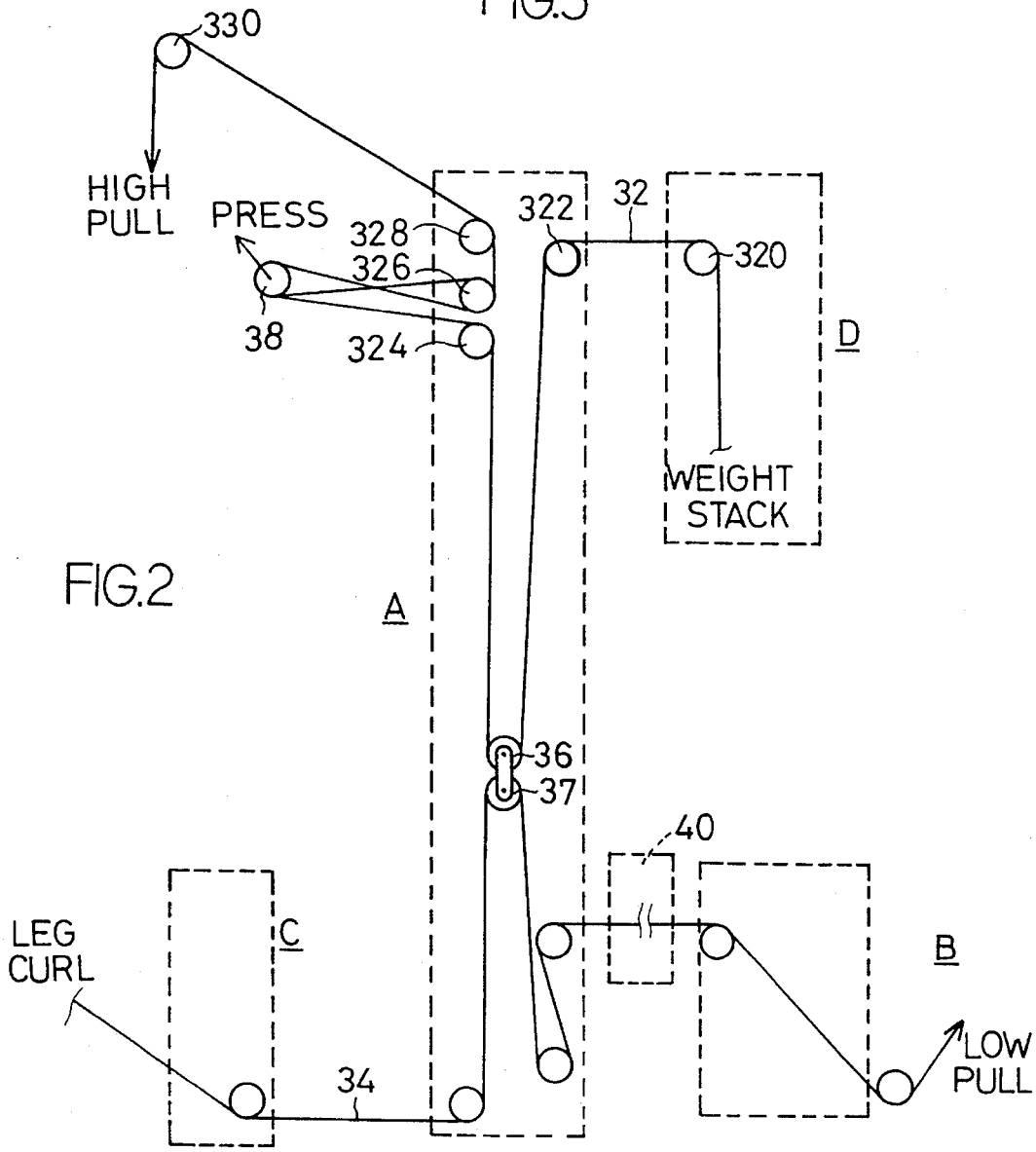
FIG. 2 is a schematic of the cable and pulley system for loading the exercise stations with a weight stack.

Referring to the drawings, and particularly to FIG. 1, a multi-station exercise machine is shown to have a frame structure of the present invention. Except for the frame structure which will be fully described later, the other parts of the machine are shown for purposes of example to include a high pull unit and a press unit located at station A, a butterfly unit and a low pull unit located at station B, a leg curl/extension unit at station C, and a weight stack unit D (not clearly visible in FIG. 1). At each station, it can be seen that a column 10, 12, 14 or 16 is disposed. The columns each have a hexagonal cross-section and are of a similar structure but with different longitudinal length or height to suit the needs and requirements of the particular exercise unit. The columns can be suitably deemed as a support frame of an exercise station or a support frame of a weight stack unit. The function and use of various exercise units are well-known or ordinary so their description will be omitted. However, the relating cable and pulley system will be briefly mentioned in the following paragraph particularly with reference to FIG. 2.

The cable and pulley system comprises two cables, namely one upper cable 32 in conjunction with one lower cable 34 by way of a floating pulley set 36–37, the two pulleys 36 and 37 being coupled together. The upper cable 32 leads out from the weight stack unit at station D, passing over two stationary pulleys 320 and 322, the floating pulley set 36–37, and a number of pulleys 324, 38, 326, 328 and 330 to the high pull unit and the press unit at station A. The pulley identified by numeral 38 is a floating one, and preferably is consisted of two separate pulleys arranged in parallel. The stationary pulley 326 is likewise consisted of two separate pulleys and is arranged in parallel. This situation is shown by cross lines between the pulley 38 and the pulley 326. A press exercise can therefore be performed as desired, resisting the load from the weight stack. It is noted that, when the situation should arise such as when one or more exercise units or stations are to be added to an exercise machine incorporating the frame structure of the invention, a floating pulley or equivalent means like the floating pulley 38 can be added to the path of the upper cable for use by the said one or more exercise units or stations. In a like manner, the lower cable 34 passes over a number of pulleys (not numbered) to complete a cable and pulley sub-system so that the butterfly unit and the low pull unit at station B and the leg curl/extension unit at station C can operate resisting the load from the weight stack via the floating pulley set 36–37. For ease of understanding, the various stations A through D are identified by blocks of dotted lines which as can be understood also schematically represent the associated columns 10, 12, 14 and 16, respectively. Attention is directed to the butterfly unit (represented by block 40) optionally disposed between the columns 10 and 12, which will be described later with reference to FIGS. 4 through 6. The addition of the butterfly unit, with the introduction of associated cable and pulley sub-system into the path of the lower cable 34, is one example that an additional exercise unit can be operatively introduced into the exercise machine, just like a floating pulley can be added to the path of the upper cable 32.

Figure 7:
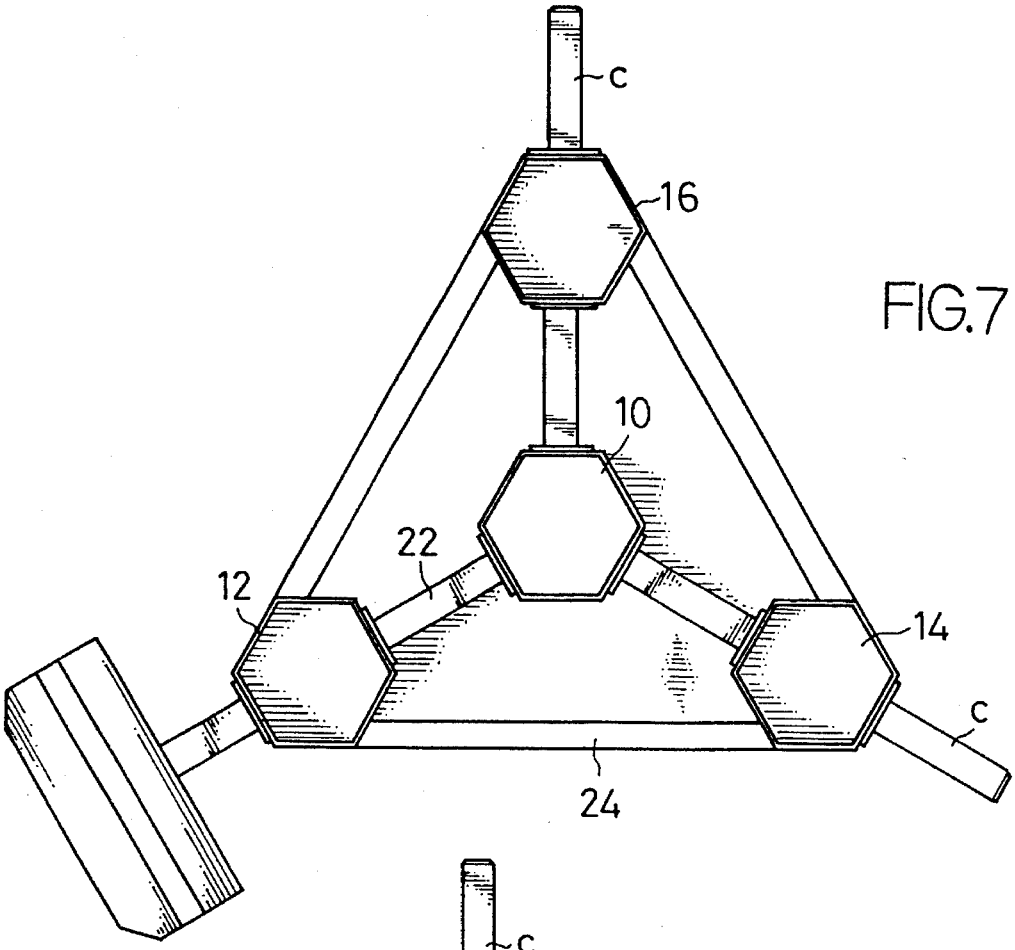
FIG. 7 is a schematic showing a standard base support assembly in accordance with the present invention.

The column 12 associated with station B, the column 14 associated with station C and the column 16 associated with station D respectively constitute one of the three apexes of a triangle as seen from a top view, referring also to FIG. 7. The column 10 associated with station A then is situated approximately at a center of gravity or centroid of the triangle. As can be seen, in connection with this triangular arrangement of the columns, the frame structure (generally represented by numeral 1) of the invention comprises a base support assembly 20 which is also of a generally triangular configuration.

Figure 3A:
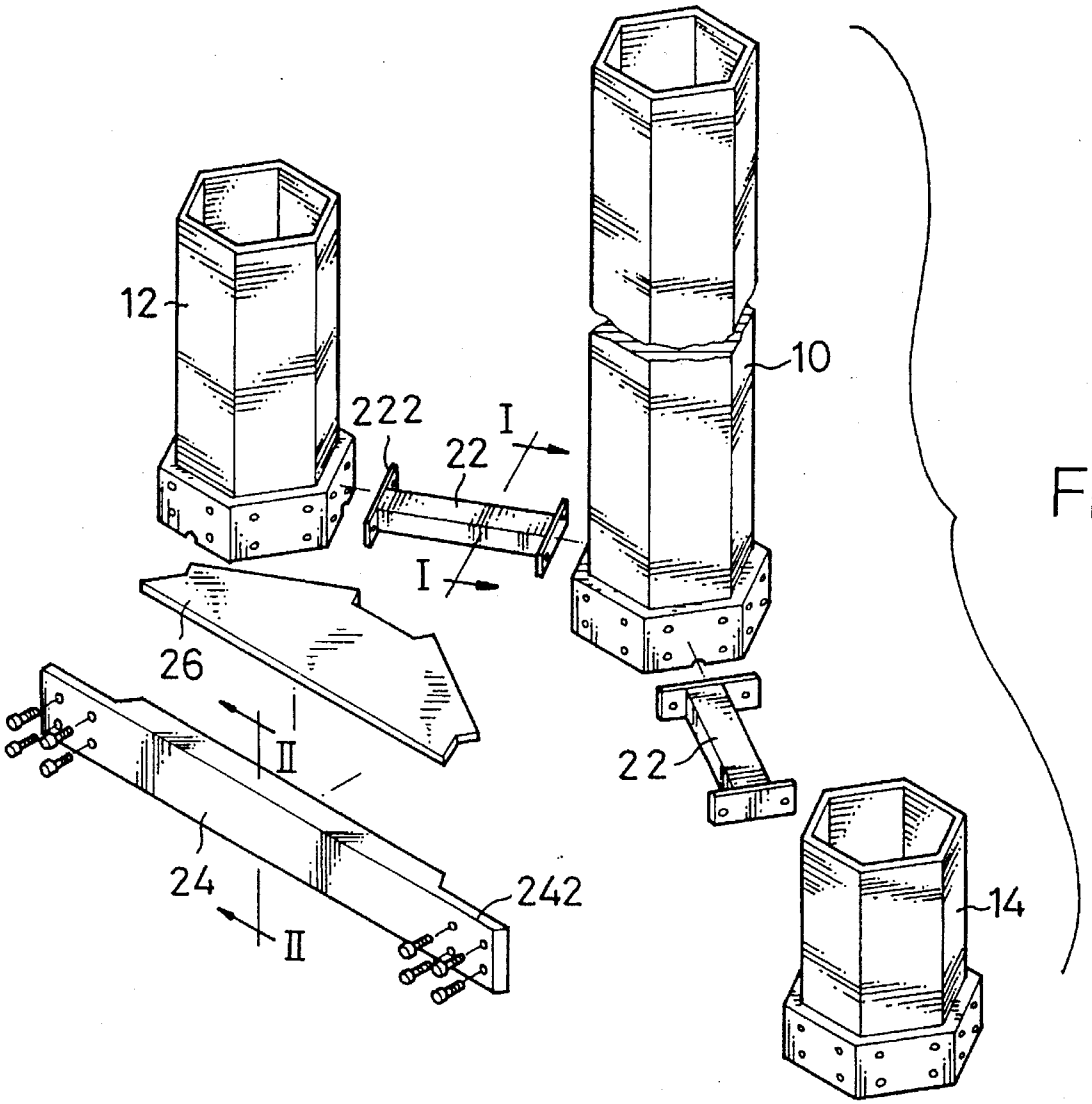
FIG. 3A is an exploded perspective view showing the construction of the base support assembly.
Figure 3B:
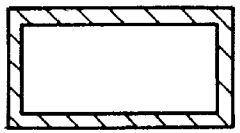
FIG. 3B is a cross-sectional view taken along lines I—I in FIG. 3A.
Figure 3C:
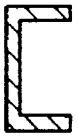
FIG. 3C is a cross-sectional view taken along line II—II in FIG. 3A.

Referring to FIG. 3, the base support assembly 20 shown in exploded view for a part thereof comprises a set of cross beams 22 (only two are shown in this figure) and a set of cross beams 24 (only one is shown in this figure). The first set of cross beams 22 each fixedly connect the centrally located column, i.e., the column 10 for station A in this embodiment, to the columns located at the apexes of the base support assembly 20. The second set of cross beams 24 each are fixedly interconnected between the columns at the apexes of the base support assembly 20, i.e., columns 12 and 14 in FIG. 3. The cross beams 22 and 24 are fixed in place on the bottom part of the columns by any suitable fasteners or in any known means. A board 26 is employed and shaped to cover the space enclosed by the cross beams and the columns. Preferably, the cross beam 22 has a central portion of a rectangular cross-section with each of its two ends terminating as a planar part or plate 222 to be fixed to a vertically facing side of a hexagonal lower end of a column. The cross beam 24 has a central portion of a substantially U-shaped cross-section with each of its two ends 242 terminating as a planar part or plate 242 to be fixed to a laterally facing side of the hexagonal lower end of associated column.

Figure 5:
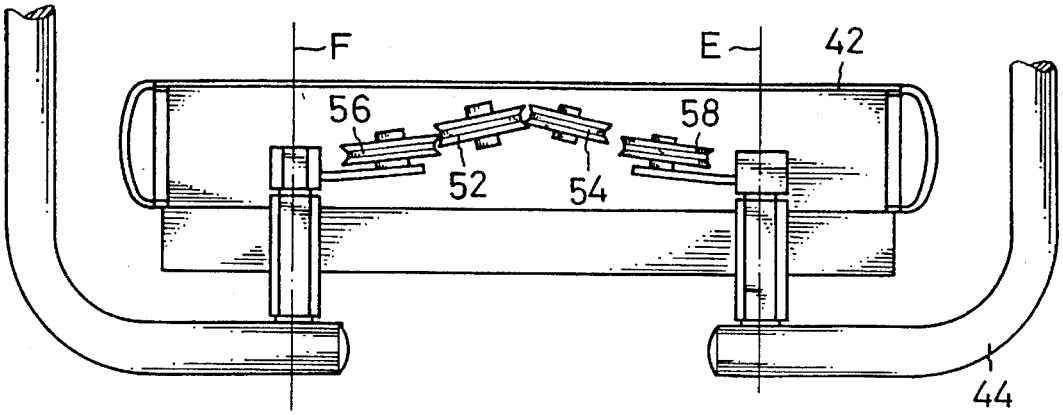
FIG. 5 is a cross-section of FIG. 4 taken along line 5—5, showing the arrangement of the cable and pulley subassembly within the butterfly module.
Figure 4:
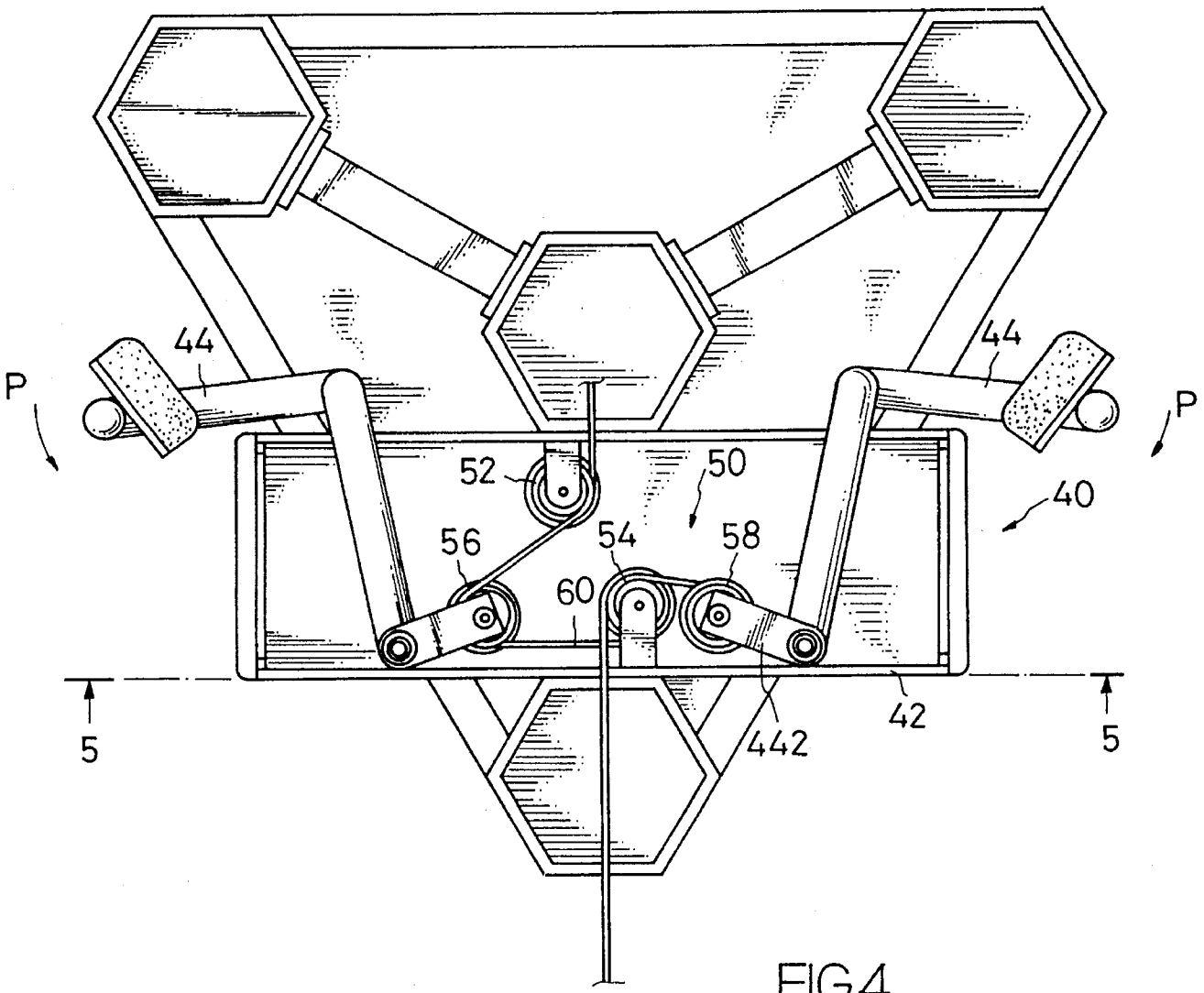
FIG. 4 is a top view showing the components of the butterfly module, the module being in a condition before use.
Figure 6:
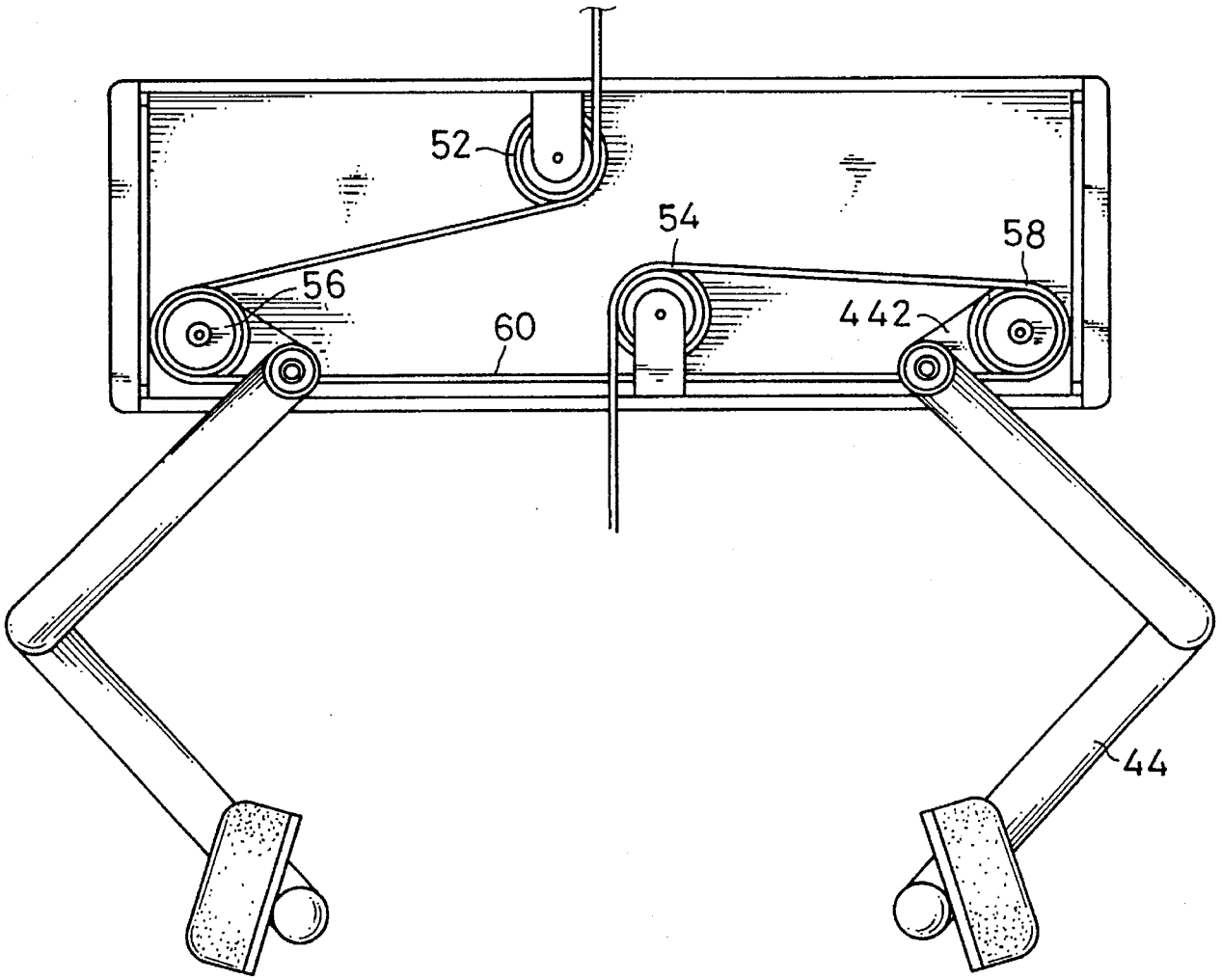
FIG. 6 is a view similar to FIG. 4 but showing the module in a maximum pivoted position.

As mentioned previously, the butterfly unit can be conveniently introduced into the exercise machine. Referring to FIGS. 4 through 6, the butterfly unit is characterized by a butterfly module 40 which comprises a rectangular box 42 (its cover being removed for ease of description), a cable and pulley sub-system 50 within the box 42, and a pair of pivoting rods 44. The cable and pulley sub-system 50 comprises an inlet stationary pulley 52, an outlet stationary pulley 54, a pair of floating pulleys 56 and 58, and a cable 60. The pulleys 56 and 58 are mounted on respective end portion 442 thereof. The cable 60 as shown passes over the inlet stationary pulley 52, the floating pulley 56, the floating pulley 58 and the outlet stationary pulley 54 in sequence. The pivoting rods 44 therefore are coupled to the cable and pulley sub-system 50 and are capable of performing a pivotal movement about axes E and F in a direction as indicated by arrows P, resisting a force or load applied via the cable and pulley sub-system 50, to a fully pivoted position as shown in FIG. 6. In this fully pivoted position of FIG. 6, the rods 44 have pivoted with the floating pulleys 58 and 60 moving away from the stationary pulleys 52 and 54. To facilitate a smooth pivotal movement of the rods 44, the inlet and outlet stationary pulleys 52 and 54 are tilted in opposite directions with respect to the direction of an axis of the pivotal movement of the pivoting rods. This tilting arrangement can be clearly seen in FIG. 5.

The essence of the invention lies in the arrangement of the base support assembly and the columns it supports. In accordance with the present invention, either the central or the outer columns can be utilized in expansion or addition of one or more additional units or stations. In said expansion or addition, a cross beam of same construction but different length will be connected between the column selected to be utilized and the column to be added in a manner just like a cross beam 22 is connected between the central column and one outer column, as well as suitable beams will be provided as depending on the structural stability considerations.

Figure 8:
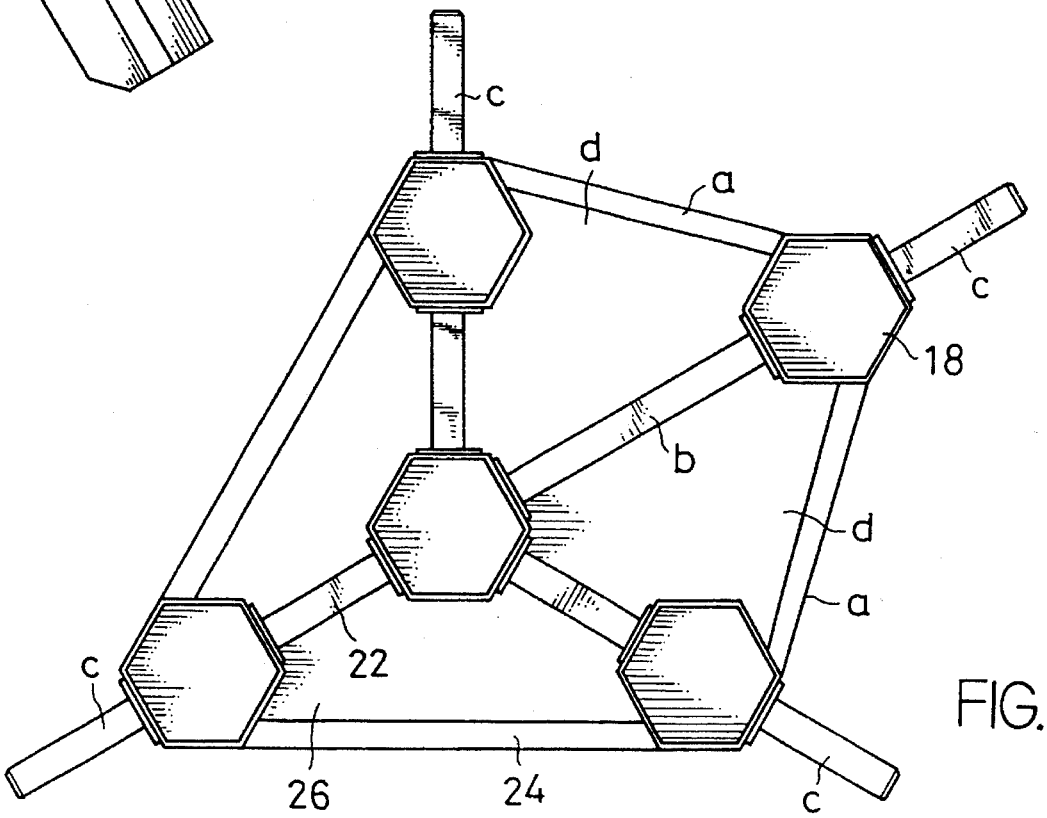
FIG. 8 is a schematic showing an expanded base support assembly in accordance with the present invention.

A basic arrangement of the columns involves the use of the standard base support assembly and four columns as shown in FIGS. 1 and 7. To accommodate the addition of an additional column, i.e., to expand the machine to include one additional exercise unit or station, it will be disposed at a position outside the standard base support assembly, preferably in a direction opposite to the axis of either cross beam 22. For this purpose additional cross beams, "a" and "b" of similar structure, but different lengths with respect to cross beams 22 and 24 can be suitably used. The actual position is not that critical but is should be adjacent to existing columns. For instance, if desired, the position of the column can be so chosen that beam "a" has a length equal to the beam 24, beam "b" then is of same construction as the beam 22 but will be longer in length. Or the length of the beam "b" can be chosen so that it is twice the length of the cross beam 22. Associated boards "d" are correspondingly provided. An exemplary position of this additional column is shown in FIG. 8 at position 18. It is noted that in either FIG. 7 or FIG. 8, although an additional exercise unit or station is not present, a cross beam "c" having a design and construction similar to cross beam 22 is disposed at each outer column, in order to increase contact area with ground and therefore the stability of the exercise machine.

Figure 9:
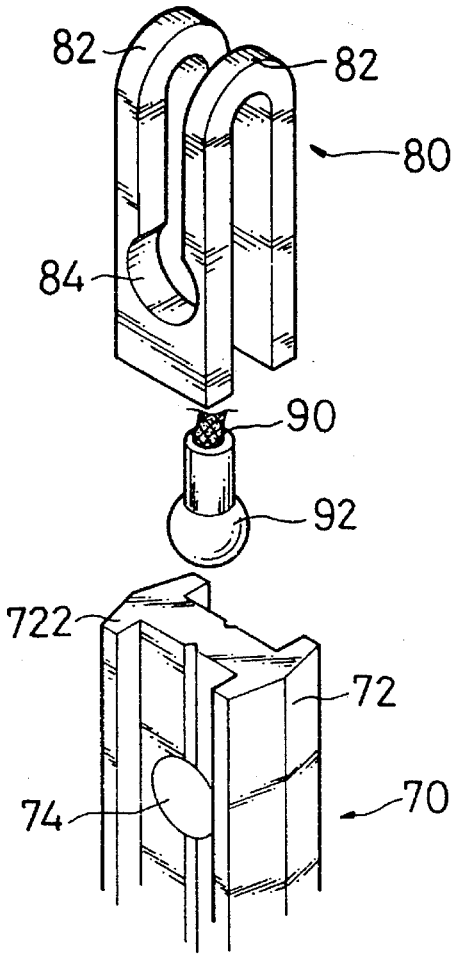
FIG. 9 is a perspective view showing a top of a guide rod which can be adapted to steel cable.
Figure 10:
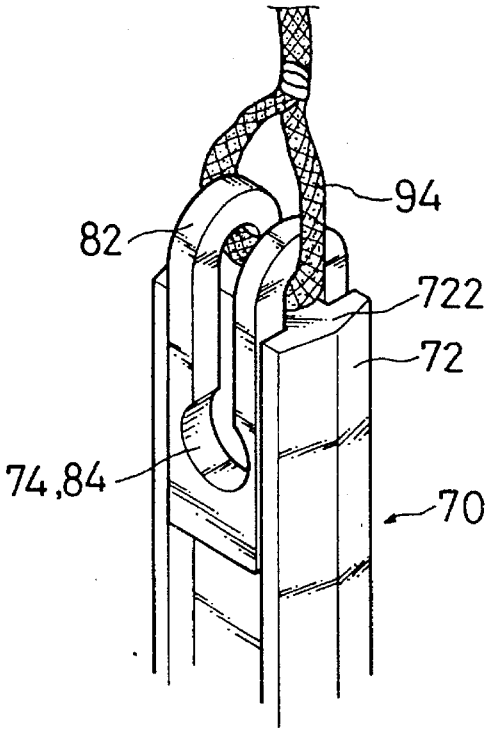
FIG. 10 is a view similar to FIG. 9 but showing the top of the guide rod which is adapted to a rope.

Additionally, as shown in FIGS. 9 and 10, a guide rod (only a top portion thereof being) of the weight stack can be suitably adapted to connect with either a steel cable (FIG. 9) or a rope (FIG. 10). The guide rod 70 has a generally I-shaped cross-section. A slide block 80 can be fitted to a top 72 of the guide rod 70, then a fastener, such as a bolt and nut (not shown), can be used to fix the slide block 80 to the guide rod 70 through holes 74 and 84 on the top 72 of the guide rod 70 and the slide block 80, respectively. To adapt to a steel cable 90 (only an end portion thereof being shown), it is firmly clamped by a ball-pin piece 92, then the piece 92 can be slid into and confined between a pair of angle arms 82 and an end planar surface 722 of the top 72. To adapt to a rope 94, it can be fastened directly on the pair of angle arms 82.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An exercising machine frame comprising:

a) a base support assembly of a generally polygonal shape having a plurality of corners;

b) a first column disposed at a centroid of the base support assembly;

c) at least three second columns, each second column being disposed at a respective corner of the base support assembly;

d) a plurality of first cross beams each first cross beam connecting one of said second columns to said first column;

e) a plurality of second cross beams each second cross beam extending between two of said second columns, whereby one of said first and second columns constitute a support frame of a weight stack unit and the remaining other columns each constitute a support frame for an exercise station; and, f) a butterfly module disposed between said first column and one of said second columns which constitutes a support frame for a butterfly exercise station, said butterfly module comprising: a box; a cable and pulley sub-system within said box, and a pair of pivoting rods pivotally connected to said box and coupled to said cable and pulley sub-system whereby a pivotal movement resisting a force is applied to said pivoting rods via said cable and pulley sub-system in response to a load from a weight stack unit.

2. The exercise machine frame as claimed in claim 1, further comprising a plurality of third cross beams extending from a plurality of said second columns outwardly from said base support.

3. The exercise machine frame as claimed in claim 1, wherein said cable and pulley sub-system comprises: an inlet stationary pulley; an outlet stationary pulley; a floating pulley mounted on each respective pivoting rod so as to move therewith; and a cable passing over said inlet stationary pulley, the floating pulleys and said outlet stationary pulley in sequence, whereby said inlet and outlet stationary pulleys are located in planes tilted in opposite directions with respect to pivoting axes of said pivoting rods to facilitate a smooth pivotal movement of said pivoting rods.

4. The exercise machine frame as claimed in claim 1, wherein said first and second columns each have a hexagonal cross-section.

5. The exercise machine frame as claimed in claim 1, wherein each cross beam of said plurality of first cross beams each have a central portion of closed rectangular cross-section and wherein each cross beam of said plurality of second cross beams each have a central portion of a substantially U-shaped cross-section.

* * * * *